US005922462A

United States Patent [19]

Kent et al.

[11] Patent Number: 5,922,462

[45] Date of Patent: Jul. 13, 1999

[54] MULTIPLE DOMAIN FIBERS HAVING SURFACE ROUGHENED OR MECHANICALLY MODIFIED INTER-DOMAIN BOUNDARY AND METHODS OF MAKING THE SAME

[75] Inventors: Diane R. Kent; Matthew B. Hoyt, both of Arden; Charles F. Helms, Jr., Asheville, all of N.C.

[73] Assignee: BASF Corporation, Mt. Olive, N.J.

[21] Appl. No.: 09/008,843

[22] Filed: Jan. 20, 1998

Related U.S. Application Data

[60] Provisional application No. 60/038,236, Feb. 19, 1997.

[51] Int. Cl.[6] ..... D02G 3/00

[52] U.S. Cl. ..... 428/373; 428/374; 428/397

[58] Field of Search ..... 428/373, 374, 428/397

[56] References Cited

U.S. PATENT DOCUMENTS

| | | | |
|---|---|---|---|
| 2,989,798 | 6/1961 | Bannerman | 28/82 |
| 3,718,534 | 2/1973 | Okamoto et al. | 161/173 |
| 4,069,363 | 1/1978 | Segraves et al. | 428/224 |
| 4,439,487 | 3/1984 | Jennings | 428/397 |
| 4,460,649 | 7/1984 | Park et al. | 428/373 |
| 4,732,809 | 3/1988 | Harris et al. | 428/373 |
| 4,956,236 | 9/1990 | Wang | 428/373 |
| 5,125,818 | 6/1992 | Yeh et al. | 425/131.5 |
| 5,162,074 | 11/1992 | Hills | 156/644 |
| 5,202,185 | 4/1993 | Samuelson | 428/373 |
| 5,244,614 | 9/1993 | Hagen | 264/78 |
| 5,344,297 | 9/1994 | Hills | 425/131.5 |
| 5,352,518 | 10/1994 | Muramoto et al. | 428/373 |
| 5,445,884 | 8/1995 | Hoyt et al. | 428/370 |
| 5,533,883 | 7/1996 | Hodan et al. | 425/131.5 |
| 5,551,588 | 9/1996 | Hills | 216/56 |
| 5,582,913 | 12/1996 | Simons | 428/373 |
| 5,780,156 | 7/1998 | Hoyt et al. | 428/373 |

*Primary Examiner*—Newton Edwards

[57] ABSTRACT

Multicomponent fiber and a method of producing the same whereby the inter-domain boundary layer between the distinct domains is surface roughened and/or mechanically modified so as to increase the surface area contact (and thereby the adhesion) therebetween. As such, delamination of the domains at their interfacial boundary layer is minimized (if not eliminated entirely). Preferably, the fibers are concentric core-sheath bicomponent fibers whereby the core is surface roughened and/or mechanically modified so that of the inter-domain boundary layer between the core and the sheath appears in cross-section to be serrated, undulated and/or ribbed so as to provide a core domain with a shape factor of between about 25 to about 55.

9 Claims, 2 Drawing Sheets

MULTIPLE DOMAIN FIBERS HAVING SURFACE ROUGHENED OR MECHANICALLY MODIFIED INTER-DOMAIN BOUNDARY AND METHODS OF MAKING THE SAME

This application claims the benefit of U.S. Provisional Patent Application Ser. No. 60/038,236, filed Feb. 19, 1997, now abandoned.

FIELD OF INVENTION

The present invention relates generally to synthetic fibers and the techniques by which such synthetic fibers are made. More particularly, the present invention relates to synthetic fibers having multiple distinct polymer domains formed of different polymers and a surface roughened or mechanically modified inter-domain boundary layer between the distinct domains.

BACKGROUND AND SUMMARY OF THE INVENTION

Multicomponent fibers are, in and of themselves, well known and have been used extensively to achieve various fiber properties. For example, multicomponent fibers have been formed of two dissimilar polymers so as to impart self-crimping properties. See, U.S. Pat. No. 3,718,534 to Okamoto et al and U.S. Pat. No. 4,439,487 to Jennings. Multicomponent fibers of two materials having disparate melting points for forming point bonded nonwovens are known, for example, from U.S. Pat. No. 4,732,809 to Harris et al. Asymmetric nylon-nylon sheath-core multicomponent fibers are known from U.S. Pat. No. 4,069,363 to Seagraves et al.

One problem that is encountered when multicomponent fibers are formed having distinct domains of dissimilar polymers which are incompatible with one another is that the domains often separate at the boudary between the domains. This separation results in fracturing or splitting of the fiber thereby weaking the system (e.g., yarn, fabric, carpet or like textile product) in which the fiber is used. Weakening of the fiber system can be sufficiently acute to prevent the system from undergoing downstream processing (e.g., drawing, texturing, heat-setting, tufting, knitting, weaving and the like). Furthermore, such fracturing and/or splitting of the fibers can result in poor product qualities such as poor appearance and poor wear performance.

It would therefore be higly desireable if multicomponent fibers having distinct longitudinally coextensive polymer domains formed of incompatible polymers could be produced which have minimal (if any) inter-domain fracturing and/or splitting. It is towards providing such a fiber and method of producing the same that the present invention is directed.

Broadly, the present invention is directed to a multicomponent fiber and a method of producing the same whereby the inter-domain boundary layer between the distinct domains is surface roughened and/or mechanically modified so as to increase the surface area contact (and thereby the adhesion) therebetween. As such, delamination of the domains at their interfacial boundary layer is minimized (if not eliminated entirely). Preferably, the fibers of this invention are concentric core-sheath bicomponent fibers whereby the core is surface roughened and/or mechanically modified so that of the inter-domain boundary layer between the core and the sheath appears in cross-section to have multiple circumferentially spaced-apart outwardly extending serrations, ribs and/or peaks.

These and other aspects and advantages of the present invention will become more clear after careful consideration is given to the detailed description of the preferred exemplary embodiments thereof which follow.

BRIEF DESCRIPTION OF THE DRAWINGS

Reference will hereinafter be made to the accompanying drawings wherein like reference numerals throughout the various Figures denote like structural elements, and wherein.

DETAILED DESCRIPTION OF THE PREFERRED EXEMPLARY EMBODIMENTS

Figure 1:
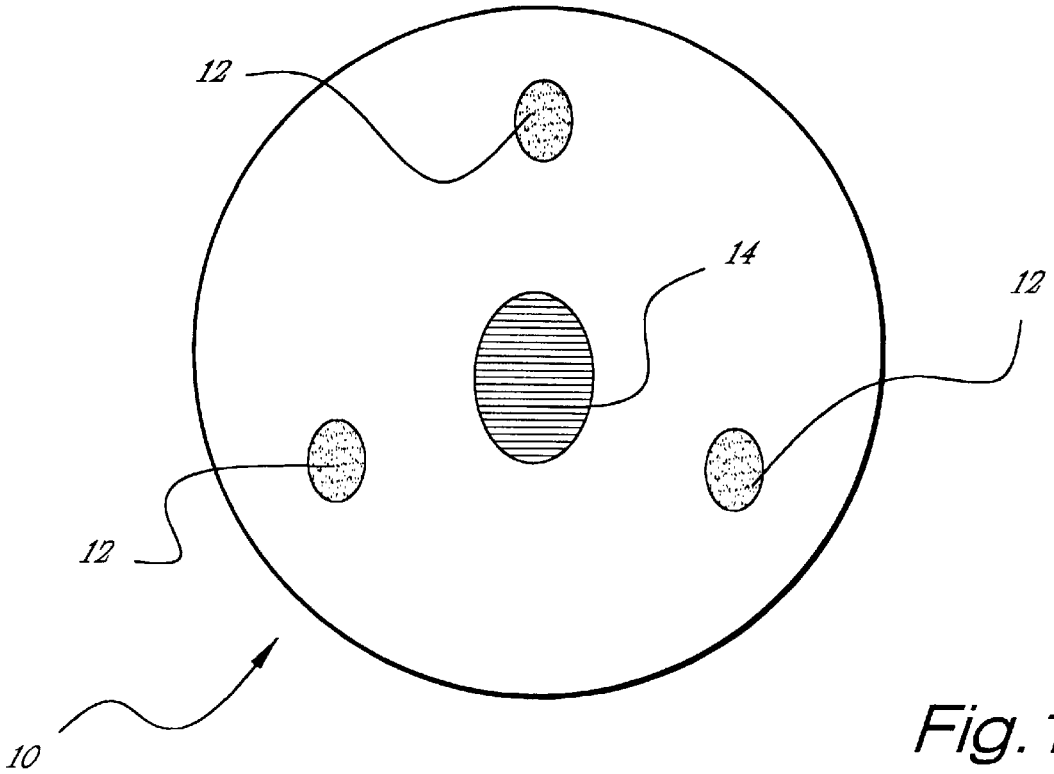
FIGS. 1 and 2 are enlarged diagrammatic plan views of polymer flow distribution plates that may be employed in a fiber spin pack to produce a representative multicomponent fiber according to the present invention.

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%. The term "non-fiber-forming" is therefore meant to refer to amorphous (non-crystalline) linear polymers which may be formed into a fiber structure, but which are incapable of being drawn without breakage at least about 10%.

The term "fiber" includes fibers of extreme or indefinite length (filaments) and fibers of short length (staple). The term "yarn" refers to a continuous strand or bundle of fibers.

The terms "multicomponent fiber" or "bicomponent fiber" are meant to refer to fibers having at least two distinct cross-sectional longitudinally coextensive domains respectively formed of different polymers. The distinct domains may thus be formed of polymers from different polymer classes (e.g., nylon and polypropylene) or be formed of polymers from the same polymer class (e.g., nylon) but which differ in their respective relative viscosities. The term "multicomponent fiber" is thus intended to include concentric and eccentric sheath-core fiber structures, symmetric and asymmetric side-by-side fiber structures, island-in-sea fiber structures and pie wedge fiber structures. Preferably, the fibers of the present invention are concentric core-sheath bicomponent fibers.

Virtually any fiber-forming polymer may usefully be employed in the practice of this invention. In this regard, suitable classes of polymeric materials that may be employed in the practice of this invention include polyamides, polyesters, acrylics, polyolefins, maleic anhydride grafted polyolefins, and acrylonitriles. More specifically, nylon, low density polyethylene, high density polyethylene, linear low density polyethylene and polyethylene terephthalate may be employed.

One particularly preferred class of polymers used in forming the bicomponent fibers of this invention is polyamide polymers. In this regard, those preferred polyamides useful to form the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4/6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ϵ-caprolactam (nylon 6) and polyhexamethylene adipamide (nylon 6/6). Most preferred is nylon 6. The preferred polyamides will exhibit a relative viscosity of between about 2.0 to about 4.5, preferably between about 2.4 to about 4.0.

Another suitable class of polymers that is generally incompatible with polyamides is polyolefin polymers, such as polyethylene, polypropylene and the like. When nylon 6 is employed as one domain of the multicomponent fiber according to this invention, polypropylene is preferred for at least one other domain.

The distinct domains of the multicomponent fibers according to this invention may also formed of an amorphous linear polymer which in and of itself is non-fiber-forming. Suitable amorphous polymers for use in the practice of this invention include polystyrene, polyisobutene and poly(methyl methacrylate). When employed as a core domain, the amorphous polymer is most preferably an amorphous polystyrene, with amorphous atactic polystyrene being particularly preferred.

Each distinct domain forming the bicomponent fibers of this invention may be formed from different polymeric materials as described above. Alternatively, some of the domains may be formed from the same polymeric materials which differ in terms, e.g., of their relative viscosities, additive content, and the like.

The multicomponent fibers are spun using conventional fiber-forming equipment. Thus, for example, separate melt flows of the polymers may be fed to a conventional multicomponent spinnerette pack such as those described in U.S. Pat. Nos. 5,162,074, 5,125,818, 5,344,297, 5,445,884 and 5,533,883 (the entire content of each patent being incorporated expressly hereinto by reference) where the melt flows are combined to form extruded multi-lobal (e.g., tri-, tetra-, penta- or hexalobal) fibers having two distinct polymer domains, for example, sheath and core structures.

Preferably, the spinnerette is such that fibers having a tri-lobal structure with a fiber modification ratio of at least about 2.0, more preferably between 2.2 and 4.0 may be produced. In this regard, the term "fiber modification ratio" means the ratio $R_1/R_2$, where $R_2$ is the radius of the largest circle that is wholly within a transverse cross-section of the fiber, and $R_1$ is the radius of the circle that circumscribes the transverse cross-section.

As noted above, the fibers of this invention preferably have a core-sheath structure wherein the core is surface roughened or mechanically modified to form in cross-section a number of circumferentially spaced-apart serrations, undulations and/or ribs (which will hereinafter be referred to more simply as "ribs" for ease of discussion) which extend the entire longitudinal dimension of the core. The ribs are most preferably formed during the spinning process, for example, by extruding a molten flow of the core-forming polymer through a correspondingly configured ribbed spinnerette orifice. The number (n) of circumferentially spaced-apart ribs is most preferably greater than the number of lobes present in the sheath domain. Thus, for example, when a trilobal bicomponent sheath-core fiber is provided according to the present invention, the core will have at least 4 ribs.

The number and configuration of the ribs will determine to a large extent the degree of inter-domain adherence that is achieved. In this regard, the core domain in the fibers of this invention will most preferably have a shape factor (sf) of between about 25 to about 55, more preferably between about 35 to about 50. As used herein and in the accompanying claims, the term "shape factor" is the ratio $p^2/A$, where p is a linear measurement of the perimeter of the core domain, and A is the cross-sectional surface area of the core domain. By way of comparison, a conventional circular cross-sectional core domain has a shape factor of about 12.6, whereas core domains having a square and equilateral triangular cross-sectional configuration have a shape factor of about 16 and 20.8, respectively. Very high shape factors, for example, greater than about 60, are to be avoided in the fibers of this invention as they may evidence delamination and/or a loss of structural integrity during wear. Most preferably, the ribs formed on the core domain in the fibers of this invention will have a triangular cross-sectional shape, preferably substantially equilateral triangular cross-sectional shape.

The extruded fibers are quenched, for example with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

Further understanding of this invention will be obtained from the following non-limiting Examples which illustrate specific embodiments thereof.

EXAMPLE 1

The two primary polymers that are used for this Example are nylon 6 (Ultramid® BS-700F available from BASF Corporation) and polypropylene (Fortilene® 3808 available from Solvay Polymers of Houston, Tex.). The boundary surface between the two primary polymers is surface roughened or otherwise mechanically modified to increase the adhesion between the core and sheath domains of the fiber.

The polymers are extruded using equipment as described in U.S. Pat. No. 5,244,614 to Hagen (the entire content of which is expressly incorporated hereinto by reference). The relative amounts of each polymeric component are 75 wt.% nylon 6 as the sheath component and 25% polypropylene as the core component. Final extruder zone temperatures for each polymer are 275° C. for the nylon 6 and 225° C. for polypropylene. The spin pack temperature is 270° C.

The spin pack is designed using thin plates such as those described in U.S. Pat. Nos. 5,344,297, 5,162,074 and 5,551,588 each issued to Hills (the entire content of each being expressly incorporated hereinto by reference). Above the backhole leading to the spinning capillary are thin plates designed as illustrated in FIG. 1 to deliver the polypropylene and nylon 6 in a core-sheath configuration, respectively. Specifically, the thin plate 10 will include a number (e.g., three) equidistantly symmetrically spaced-apart holes 12 to receive the nylon 6 sheath component and a concentrically located core hole 14 to receive the polypropylene core component.

The individual polymer flows are directed by the thin plate 10 of FIG. 1 and are processed by the apparatus disclosed in U.S. Pat. No. 2,989,789 to Bannerman (the entire content of which is expressly incorporated hereinto by reference) except there is no spinnerette capillary below the chamber where the materials are combined. Instead, this is above a thin plate and spinnerette backhole such that the core-sheath flows are delivered to the backhole.

Figure 2:
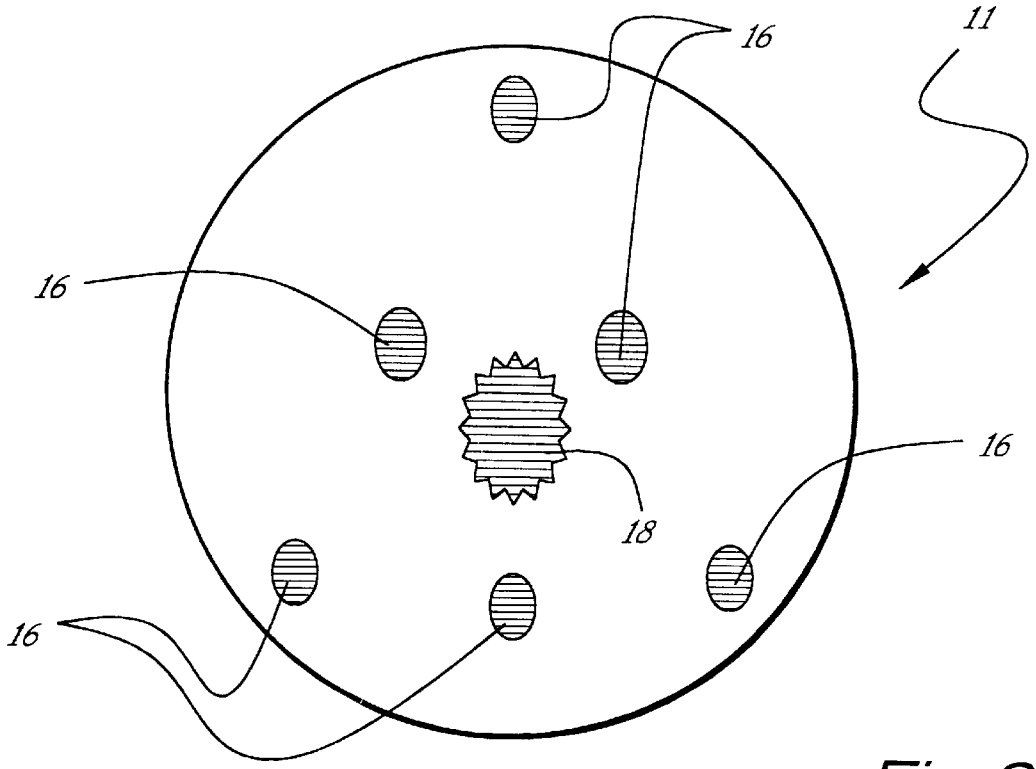
Figure 3:
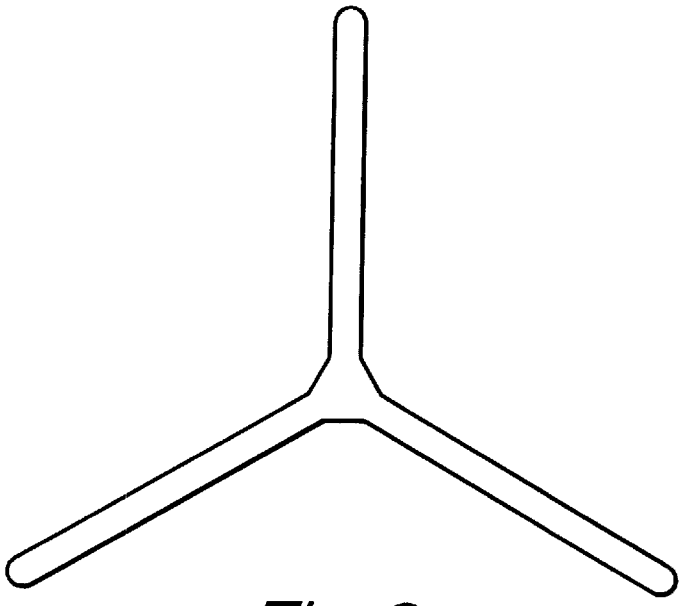
FIG. 3 is an enlarged diagrammatic plan view of a spinneret trilobal orifice configuration that may be employed downstream of the polymer flow distribution plates shown in FIGS. 1 and 2.

The entire flow of polymers—namely, the nylon 6 and polypropylene—is divided into 58 separate flows, each of which is fed into a backhole plate 11 having the pattern illustrated in FIG. 2. In this regard, the nylon 6 flow is divided among holes 16, each of which receives approximately 16.7% of the nylon 6. The thin plate 11 also includes a core hole 18 which has a surface roughened or modified surface (e.g., serrated) such that the boundary layers between the sheath and core domains do not retain a smooth interface. The backhole plate 11 feeds a conventional trilobal spinnerette opening as illustrated in FIG. 3.

The fibers are cooled, drawn and textured in a continuous spin-draw apparatus (Rieter J0/10) using a draw ration of 2.8 and a winding speed of 2200 meters per minute.

Figure 4:
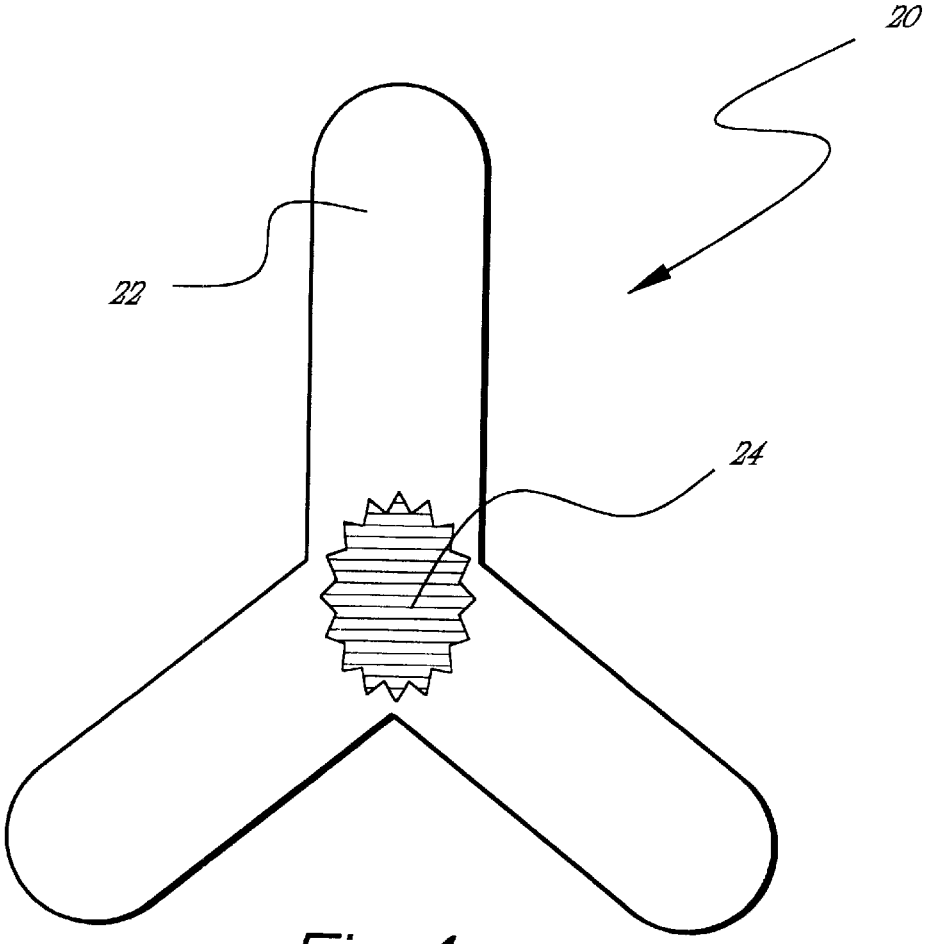
FIG. 4 is an enlarged diagrammatic cross-sectional view of one possible multicomponent fiber in accordance with this invention that may be produced using the polymer flow distribution plates and spinneret orifice depicted in FIGS. 1–3, respectively.

A cross-section of the resulting fiber 20 is shown in accompanying FIG. 4. As shown, the fiber 20 has a trilobal cross-section and includes a nylon 6 sheath 22 which entirely surrounds a concentrically positioned core 24 of polypropylene. As is seen, the interfacial boundary between the core and sheath is serrated in cross-section so as to enhance adhesion therebetween.

EXAMPLE 2 (Comparative)

Example 1 is repeated except that the proportions of material are 75% nylon 6 and 25% polypropylene, and no etching or interlocking of the layers is performed. The resulting fiber will thus have a cross-section similar to that shown in FIG. 4, except that the boundary between the core 24 and the sheath 22 is smooth.

When the fiber cross-section is viewed under a microscope, fibers from this Example 2 will show excessive delamination at the boundaries between the nylon 6 and the polypropylene domains. The fibers formed from Example 1, however, will show good adhesion between all the domains. When these fibers are converted into carpets through methods well known in the art, the carpets made from the fibers of Example 2 will show wear much earlier when subjected to foot traffic as compared to carpets formed of the fibers from Example 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A trilobal, multicomponent synthetic fiber comprising:

(a) a sheath domain formed from a first polymer, (b) a core domain formed from a second polymer selected from the group consisting of polyolefins, polystyrene polyisobutene, and poly(methyl methacrylate), wherein said core domain is entirely surrounded by said sheath domain, and (c) a modified inter-domain boundary interposed between said sheath domain and said core domain, wherein said modified inter-domain boundary has a serrated, undulated, or ribbed configuration.

2. A multicomponent synthetic fiber as in claim 1, wherein said sheath domain is formed of a nylon polymer.

3. A multicomponent synthetic fiber comprising:

(a) a nylon sheath domain, (b) a core domain formed from a second polymer selected from the group consisting of polyolefins, polystyrene, polyisobutene, and poly(methyl methacrylate), wherein said core domain has a shape factor of about 25 to about 55, and (c) a modified inter-domain boundary interposed between said sheath domain and said core domain, wherein said modified inter-domain boundary has a serrated, undulated, or ribbed configuration.

4. A multicomponent synthetic fiber as in claim 3, in the form of a trilobal fiber.

5. A trilobal, multicomponent synthetic fiber comprising a first domain formed from a first polymer and a second domain formed from a second polymer, said first domain and said second domain being longitudinally coextensive, wherein said first domain comprises a nylon sheath domain and said second domain is a core domain concentric with said sheath domain, said core domain having at least four outwardly extending, longitudinally oriented circumferentially spaced-apart ribs, wherein said core domain has a shape factor of about 25 to about 55.

6. A multicomponent synthetic fiber as in claim 5, wherein said core domain is formed from a polyolefin.

7. A multi-lobal drawn multicomponent carpet fiber as in claim 1, which is tri-lobal.

8. A yarn comprised of a plurality of carpet fibers as in claim 7.

9. A fabric comprised of a plurality of fibers as in claim 1 or 3–6.

* * * * *